US005383441A

United States Patent [19]

Lightcap, Jr.

[11] Patent Number: 5,383,441

[45] Date of Patent: Jan. 24, 1995

[54] ADJUSTABLE ARROW REST ASSEMBLY

[76] Inventor: L. Lawrence Lightcap, Jr., 509 Main St., Pennsburg, Pa. 18073

[21] Appl. No.: 68,640

[22] Filed: May 27, 1993

[51] Int. Cl.[6] ..... F41B 5/22

[52] U.S. Cl. ..... 124/44.5; 124/24.1

[58] Field of Search ..... 124/23.1, 24.1, 25.6, 124/44.5, 86, 88

[56] References Cited

U.S. PATENT DOCUMENTS

| | | | |
|---|---|---|---|
| 4,344,409 | 8/1982 | Barner | 124/24.1 |
| 4,838,237 | 6/1989 | Cliburn | 124/44.5 |
| 4,899,716 | 2/1990 | Martin et al. | 124/44.5 |
| 4,961,265 | 10/1990 | Roberts | 33/265 |
| 5,022,378 | 6/1991 | Rhodelhouse et al. | 124/44.5 |
| 5,025,773 | 6/1991 | Hintze et al. | 124/44.5 |
| 5,042,450 | 8/1991 | Jacobson | 124/44.5 |
| 5,052,364 | 10/1991 | Martin et al. | 124/44.5 |
| 5,062,407 | 11/1991 | Newbold | 124/44.5 |
| 5,065,731 | 11/1991 | Smith | 124/44.5 |
| 5,070,855 | 12/1991 | Troncoso | 124/44.5 |
| 5,085,201 | 2/1992 | Teeper et al. | 124/44.5 |
| 5,095,884 | 3/1992 | Mertens | 124/44.5 |
| 5,103,797 | 4/1992 | Newbold | 124/44.5 |
| 5,117,803 | 6/1992 | Johnson | 124/44.5 |
| 5,137,006 | 8/1992 | Gallops | 124/44.5 |
| 5,253,633 | 10/1993 | Sisko | 124/44.5 |

*Primary Examiner*—Randolph A. Reese
*Assistant Examiner*—John A. Ricci
*Attorney, Agent, or Firm*—Eric A. LaMorte

[57] ABSTRACT

The present invention arrow rest includes a mounting element that can be selectively attached to the archery bow. An interchangeable arrow support assembly is attached to the mounting element. The arrow support assembly includes a positioning mechanism that automatically positions the arrow support assembly into a desired position on the mounting element as the arrow support assembly is attached to the mounting element. As such, an archer can preadjust several arrow support assemblies for different shooting conditions such as arrow weight, target distance and the like. As a result, the archer need only change the arrow support assembly with another to ready his or her bow to a new shooting condition. The preadjusted arrow support assemblies eliminate the time consuming step of having to readjust the arrow rest each time shooting conditions change.

19 Claims, 4 Drawing Sheets

ADJUSTABLE ARROW REST ASSEMBLY

BACKGROUND OF THE INVENTION

1. Field of the Invention

The present invention relates in general to arrow rest devices mounted on archery bows that help hold and guide an arrow as it is drawn and released. More particularly, the present invention relates to arrow rests having a modular construction wherein the portion of the arrow rest that engages an arrow may be quickly interchanged with another preadjusted rest to accommodate a change in the arrows being used by the archer or a change in the shooting conditions the archer faces.

2. Description of the Prior Art

An arrow rest is a device positioned on an archery bow that supports an arrow as it is drawn by an archer and guides flight of the arrow as it is released. Due to the growing popularity of archery, the prior art record is replete with different designs of arrow rests that provide variable adjustment features to the archer. Many prior art arrow rests enable an archer to adjust the arrow rest both vertically and horizontally with respect to the bow so as to permit the archer to adapt the arrow rest for different conditions, different target distances and different arrow types. An example of such a prior art arrow rest is shown in U.S. Pat. No. 5,117,803 to Johnson, entitled ADJUSTABLE ARROW REST.

The problem with many prior art arrow rests is that they have no positional memory in their adjustments and require a substantial amount of time to adjust. A proficient archer does not adjust the arrow rest each and every time he or she uses the bow. Rather, through trial and error, a preferred adjusted position is obtained for each type of shooting condition, target distance or type of arrow used. For instance, an archer may use one arrow rest position for competition arrows, however, during hunting, when heavier arrows are typically used, a second, different arrow rest position may be preferred. In such a scenario, an archer using prior art arrow rests must adjust the arrow rest each time he or she changes arrows or when another shooting condition changes. However, there is no mechanism in the arrow rest to show the archer that the position of the arrow rest is exactly the same as it was the last time those specific shooting conditions were encountered. Rather, the archer must shoot the bow, make fine adjustments in the arrow rest, and attempt to recreate a preferred adjustment by trial and error.

As will be explained in the below provided specification, the present invention provides an arrow rest of modular construction, wherein different preadjusted arrow rest assemblies can be quickly interchanged on the bow to accommodate any desired shooting situation. As such, the need for repeated trial and error adjustments is eliminated.

The general concept of a modular arrow rest is not new. There are many examples in the prior art record of modular arrow rests where various parts can be quickly removed. Such prior art is exemplified by the following: U.S. Pat. No. 5,085,201 to Tepper et al., entitled ARROW REST FOR ARCHERY BOWS; U.S. Pat. No. 5,052,364 to Martin et al., entitled ADJUSTABLE ARROW REST; and U.S. Pat. No. 4,899,716 to Martin et al. entitled ARROW REST. In all of these references, the portion of the arrow rest that actually engages the arrow is removable from a bracket that mounts to the archer's bow. As a result, these references suggest that the arrow engagement element of some prior art arrow rests can be removed and replaced as desired. However, in each of these references, there is no mechanism that automatically positions a replacement arrow engagement element in a desired set position. Consequently, the arrow engagement element must be adjusted by trial and error each time it is assembled onto the arrow rest and no functional benefit is gained by the modular construction.

As has been before stated, many prior art arrow rests are adjustable both vertically and horizontally relative to the archery bow. Another important adjustment for arrow rests is the rotational adjustment of the arrow engagement element of the arrow rest about a line perpendicular to the bow. This adjustment commonly alters the height of the arrow engagement element and therefore changes the height at which the arrow is supported. This rotational adjustment changes the angle of flight for the arrow and is therefore most commonly made to compensate for a change in target distance. In the prior art, the arrow engagement elements that contact and support the arrow are typically mounted to a lateral member that can be rotated about a center axis. By rotating the lateral member and locking it into place, the height of the arrow engagement element relative the bow is controlled. Such prior art arrow rest assemblies are exemplified by the following: U.S. Pat. No. 5,103,793 to Newbold entitled ARROW REST APPARATUS; U.S. Pat. No. 4,838,237 to Cliburn entitled ARROW REST FOR ARCHERY BOWS; and U.S. Pat. No. 5,062,407 to Newbold entitled ARROW REST AND ARROW LAUNCHER ADJUSTMENT APPARATUS. A common problem with such prior art arrow rests is that once the lateral member is locked in place, it becomes static. The arrow rest of a bow experiences a great deal of external forces from the storage of the bow, handling of the bow and the use of the bow with arrows. These forces are experienced by the lateral member that supports the arrow engagement element and often moves the lateral member from its desired set position. As a result, the position of the lateral member and arrow engagement element must be periodically readjusted to the needs of the archer.

In archery, it is well known that an archer's efficiency can be increased by using a shorter arrow. Shorter arrows travel faster from a bow and because short arrows are typically lighter than long arrows, Shorter arrows are also advantageous in that they follow a flatter trajectory than do longer, heavier arrows. Most archery bows have a fixed draw length. As such, to shoot shorter arrows, an overdraw device must be used in conjunction with the bow. Such overdraw devices are exemplified by U.S. Pat. No. 5,022,378 to Rhodehouse et al., entitled ARROW REST/OVERDRAWN APPARATUS FOR AN ARCHERY BOW and U.S. Pat. No. 5,065,731 to Smith entitled ARROW REST ASSEMBLY. The use of an overdraw device often requires an archer to change the adjustments on the arrow rest to accommodate the flight characteristics of the shorter arrow. Arrow rests are typically formed as part of the overdraw device. As a result, to place an overdraw device on a bow, the regular arrow rest must be removed and the overdraw assembly assembled in its place. Consequently, the arrow rest commonly used by the archer cannot be used with the overdraw device.

In view of the prior art, it is a primary objective of the present invention to provide a modular system where an overdraw device can be used in conjunction with the preexisting arrow rest and does not require the complete disassembly of the arrow rest.

It is another object of the present invention to provide an arrow rest that includes a lateral member that is not static, but rather is biased into a set position so that the lateral member can move freely when stressed, and return to a desired position for repeated use.

It is yet another object of the present invention to provide a modular arrow rest wherein preadjusted arrow engagement elements can be quickly transposed onto a bow and are ready for use without adjustment.

SUMMARY OF THE INVENTION

The present invention is an arrow rest apparatus for use in conjunction with an archery bow. In a first embodiment, the present invention arrow rest includes a mounting element that can be selectively attached to the archery bow. An interchangeable arrow support assembly is attached to the mounting element. The arrow support assembly includes a positioning means that automatically positions the arrow support assembly into a desired position on the mounting element as the arrow support assembly is attached to the mounting element. As such, an archer can preadjust several arrow support assemblies for different shooting conditions such as arrow weight, target distance and the like. As a result, the archer need only change the arrow support assembly with another to ready his or her bow to a new shooting condition. The preadjusted arrow support assemblies eliminate the time consuming step of having to readjust the arrow rest each time shooting conditions change.

In the preferred embodiment, the arrow support assembly includes a support block, a lateral shaft extending from the support block and at least one arrow engagement element that extends from the lateral shaft and actually contacts and supports the archer's arrows. The support block is slidably attached to the mounting element and is linearly and reciprocally moveable on the mounting element. The support block also includes a locking means for locking the support block into one set position on the mounting element and a cam assembly for selectively adjusting the rotational position of the arrow engagement elements relative the support block.

In a second embodiment, a modular arrow rest arrangement is presented wherein the before mentioned arrow support assembly can be selectively mounted onto a mounting element or alternatively can be mounted directly onto an overdraw device. As such, the same set of interchangeable arrow support assemblies can be used with or without an overdraw device, thereby eliminating an archer's need to adjust different arrow rests each time an overdraw device is added to the archer's bow.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
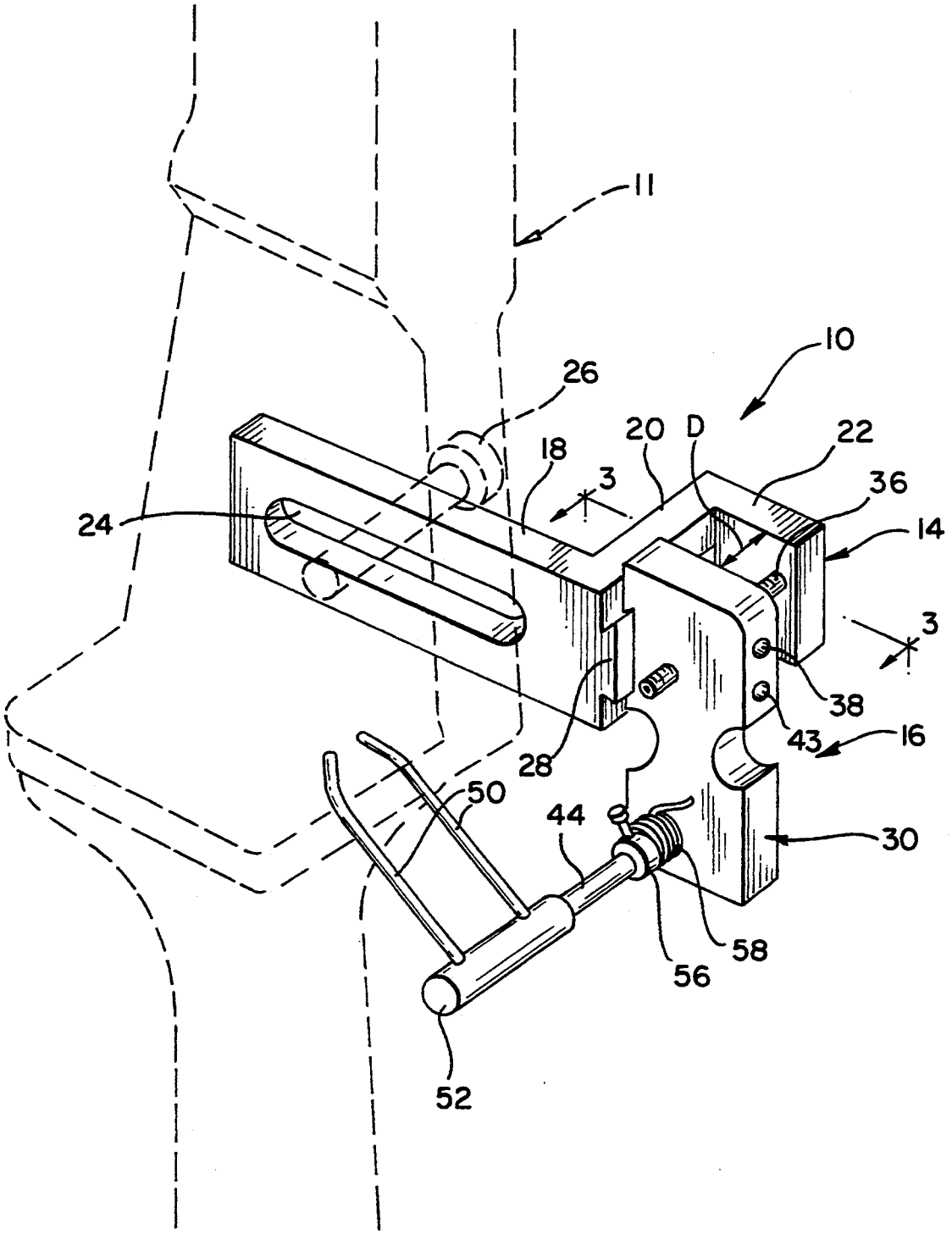
FIG. 1 is a perspective view of one preferred embodiment of the present invention arrow rest apparatus shown in conjunction with an archery bow to facilitate consideration and discussion.

Referring to FIG. 1, a segment of an archer's bow 11 is shown upon which one preferred embodiment of the present invention arrow rest assembly 10 is attached. The arrow rest assembly 10 is comprised of an anchoring bracket 14 that mounts to the bow 11 and a separate removable arrow support arrangement 16. As will be later explained, the arrow support arrangement 16 can be selectively adjusted to match an archer's needs for a certain arrow type, target distance or other variable shooting condition. The arrow support arrangement 16 can be quickly removed from the anchoring bracket 14 and replaced with a different preadjusted arrow support arrangement. As a result, an archer can quickly adjust the arrow rest assembly 10 to a specific shooting condition merely by replacing the arrow support arrangement 16.

Figure 2:
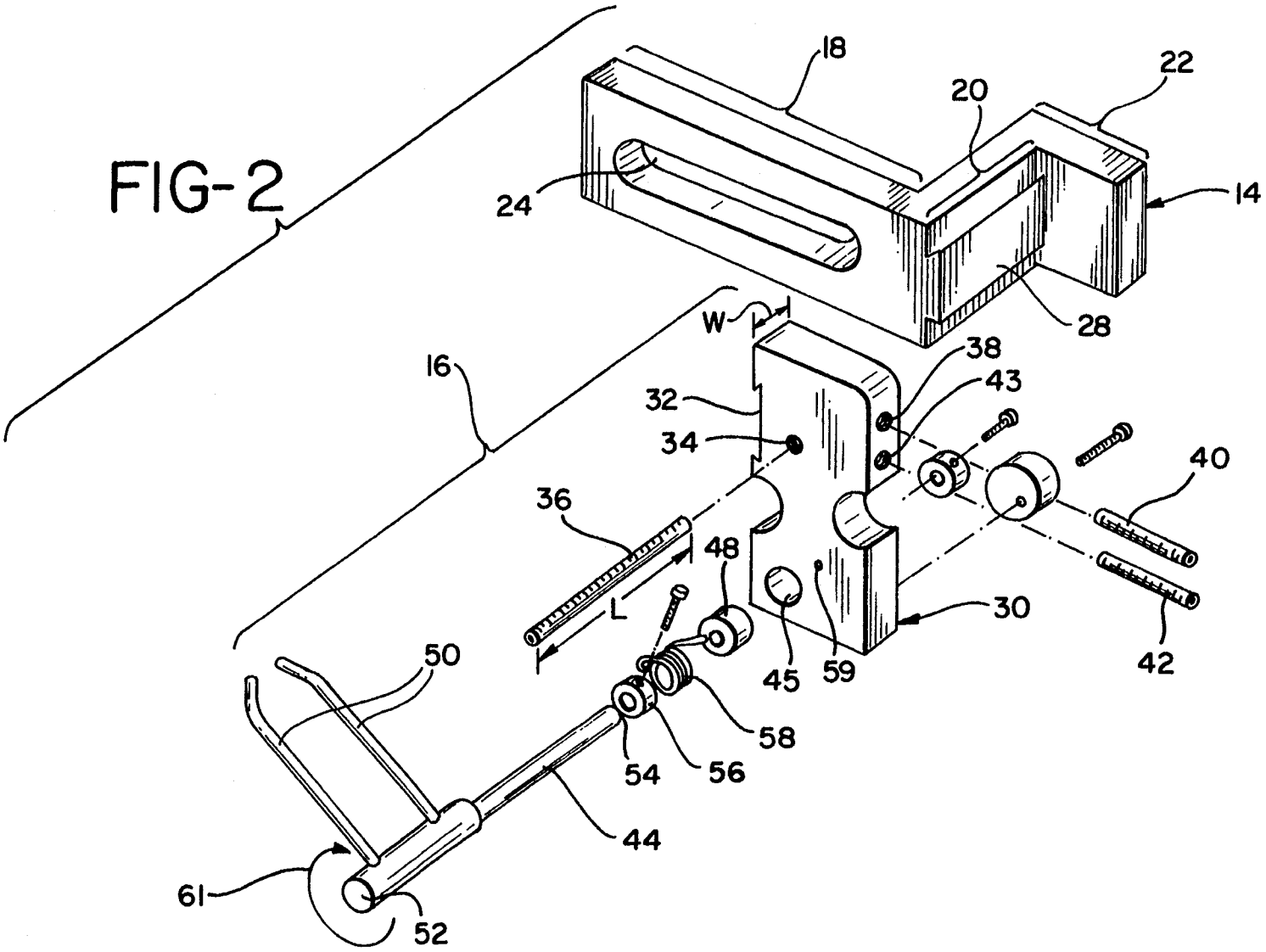
FIG. 2 is a perspective exploded view of the embodiment of FIG. 1 to show elements not otherwise visible in the perspective presented in FIG. 1.

Referring now to FIG. 2 in conjunction with FIG. 1, it can be seen that the anchoring bracket 14 has a complex shape that includes an elongated section 18, a dovetailed section 20 and an end stop section 22. An elongated slot 24 is disposed within the elongated section 18 of the anchoring bracket 14. Many archery bows are manufactured with a threaded aperture that is used in attaching arrow rest devices to the bow. A threaded fastener 26 passes through the elongated slot 24 and engages such a threaded aperture, thereby mechanically joining the anchoring bracket 14 to the bow 11. The elongated slot 24 enables the position of the anchoring bracket 14 to be adjusted back and forth in relation to bow 11. The anchoring bracket 14 is usually set in one position on the bow 11 that is comfortable for the size of the bow and the stature of the archer. It will be understood, however, that the use of an elongated slot 24 is not necessary and the elongated section 18 of the anchoring bracket 14 may include one or any number of apertures formed through it that can be used in place of the slot to affix the anchoring bracket 14 to the bow 11 with the threaded fastener 26. Similarly, any other known fastening means used to retain arrow rest devices on a bow can be employed to retain the anchoring bracket 14 to the bow 11.

The dovetailed section 20 of the anchoring bracket 14 extends at a perpendicular from the proximal end of the elongated section 18. A dovetail tenon 28 is formed along the length of the dovetailed section 20 on the surface of the dovetailed section 20 facing away from the bow 11. The use of a dovetail tenon 28 is merely exemplary and it will be understood that any other tenon shape, such as a T-shape or the like, capable of positively engaging an oppositely shaped relief may be used. The end stop section 22 of the anchoring bracket 14 extends at a perpendicular from the distal end of the dovetailed section 20.

The arrow support arrangement 16 includes a support block 30 having a relief 32 formed within one of its end surfaces. The relief 32 is sized to engage the tenon 28 extending from the anchoring bracket 14. As such, the support block 30 is free to slide back and forth along the length of the dovetailed section 20 of the anchoring bracket 14. Similarly, the support block 30 can be easily removed from, or added to, the anchoring bracket 14 by sliding the support bracket 30 past the end of the dovetailed section 20. Although the shown embodiment shows the tenon 28 on the anchoring bracket 14 and the relief 32 on the support block 30, it should be understood that these features could be reversed in position. A threaded aperture 34 is formed through the support block 30. An adjustment screw 36 having a length L that is much longer than the width W of the support block 30 is threadably engaged within the threaded aperture 34. The adjustment screw 36 is positioned within the threaded aperture 34 so that the adjustment screw 36 extends completely through the support block 30. As a result, when the support block 30 is joined to the anchoring bracket 14 and the support block 30 is advanced toward the end stop section 22 of the anchoring bracket 14, the adjustment screw 36 contacts the end stop section 22 before the support block 30 and holds the support block 30 a desired distance D away from the end stop section 22. By either tightening or loosening the adjustment screw 36, the distance D between the end stop section 22 of the anchoring bracket 14 and the support block 30 can be selectively adjusted as desired.

A second threaded aperture 38 is formed through the support block 30 that communicates with the relief 32 formed within the support block 30. A locking screw 40 is positioned within the threaded aperture 38. As a result, once the support block 30 is engaged with the anchoring bracket 14, the locking screw 40 can be tightened. The locking screw 40 engages the dovetail tenon 28 through the relief 32. Consequently, the locking screw 40 is used to lock the support block 30 into a set position on the anchoring bracket 14 and prevents the support block 30 from sliding along the dovetail tenon 28. As such, to attach the support block 30 to the anchoring bracket 14, the relief 32 on the support block 30 is advanced along the tenon 28 of the anchoring bracket 14 until the adjustment screw 36 extending from the support block 30 contacts the end stop section 22 of the anchoring bracket 14. The locking screw 40 is then tightened, locking the support block 30 into that set position a distance D from the end stop section 22. An optional second locking screw 42 may also be disposed within the support block 30. The second locking screw 42 may extend through an aperture 43 that communicates with the adjustment screw aperture 34. As such, the second locking screw can be used to secure the adjustment screw 36 into one set position within the adjustment screw aperture 34.

Although the present invention shows the adjustment screw 36, locking screw 40 and the second locking screw 42 to be recessed screws having no head, it should be understood that screws with manipulative knobs at one end can be used. As such, the adjustment screw 36, locking screw 40 and second locking screw 42 can be tightened and loosened by hand without requiring a tool.

A lateral shaft 44 extends through an aperture 45 near the base of the support block 30. An optional bearing 48 may be disposed within the aperture 45 to facilitate the free rotational movement of the lateral shaft 44 and to reduce wear between the lateral shaft 44 and the support block 30. The lateral shaft 44 itself has a proximal end 52 and a distal end 54. Two arrow engagement elements 50 extend from the lateral shaft 44 at substantially a perpendicular, near its proximal end 52. Such arrow engagement elements 50 are exemplary and are well known in the art. As such, the shown arrow engagement elements 50 may be substituted with any other known arrow engagement element used in archery.

A spring engagement hub 56 is positioned along the lateral shaft 44 near its distal end 54. The hub 56 engages one end of a torsion spring 58. A small aperture 59 is formed in the support block 30. The opposite end of the torsion spring 58 engages the small aperture 59. As such, the torsion spring 58 is coupled between the support block 30 and the lateral shaft 44. The torsion spring 58 provides a bias to the lateral shaft 44 trying to rotate the shaft about its central axis in the direction of arrow 61.

Figure 3A:
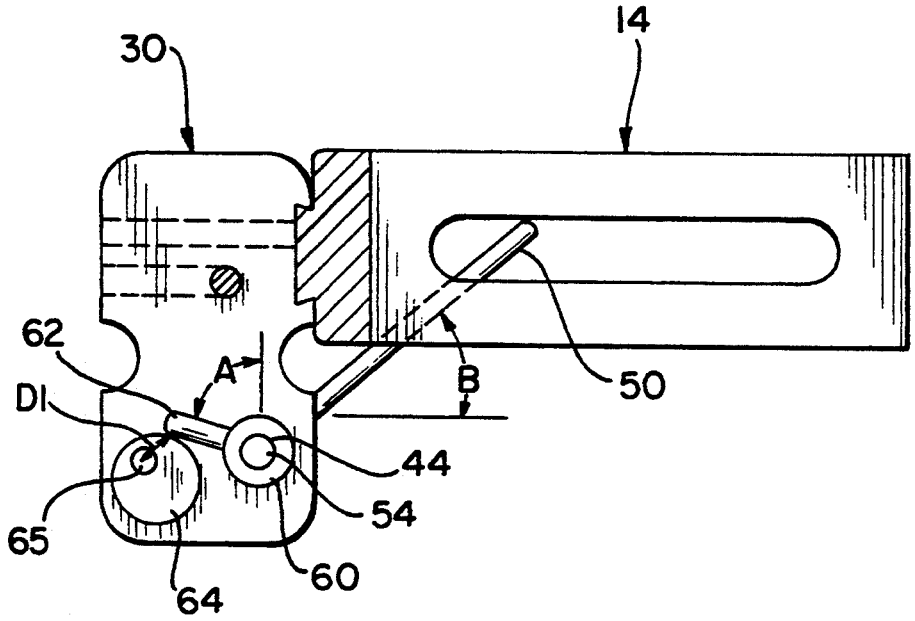
FIGS. 3*a* and 3*b* show sectional views of the present invention arrow rest apparatus, viewed along section line 3—3 as indicated in FIG. 1.

Referring to FIG. 3*a* in conjunction with FIG. 2, it can be seen that a locking hub 60 is coupled to the distal end 54 of the lateral shaft 44 on the opposite side of the support block 30 opposite the spring engagement hub 56. As such, the locking hub 60 prevents the lateral shaft 44 from being pulled out of the support block 30. An engagement finger 62 radially extends from the locking hub 60. The engagement finger 62 may be a locking screw that holds the locking hub 60 onto the lateral shaft 44 or any other structure that firmly affixes the locking hub 60 to the shaft 44. A cam member 64 is attached to the support block 30 adjacent to the locking hub 60. The cam member 64 is attached to the support block 30 by a threaded fastener 65 that extends through a hole 66 eccentrically formed through the cam member 64. The bias provided to the lateral shaft 44 by the torsion spring 58 causes the engagement finger 62 extending from the locking hub 60 to strike and be biased against the cam member 64, wherein the cam member 64 stops the engagement finger 62 and prevents the further rotation of the lateral shaft 44.

As can be seen from FIG. 3*a*, the position of the cam member 64 determines how far the engagement finger 62 on the lateral shaft 44 rotates away from the vertical. In FIG. 3*a*, the engagement finger 62 is offset from the vertical by angle A. Consequently, the cam member 64 causes the arrow engagement element 50, on the other side of the lateral shaft 44, to be held at an angle of inclination B from the horizontal. The cam member 64 only prevents the further rotation of the engagement finger 62 toward the cam member 64. However, if the arrow engagement elements 50 incur a deflectional force that sets to rotate the arrow engagement elements 50 in the direction of arrow 67, the lateral shaft 44 will rotate and the engagement finger 62 will rotate away from the cam member 64. After the deflecting force is gone, the arrow engagement elements 50 and engagement finger 62 will return to their original position under the bias of the torsion spring 58 (shown in FIG. 2). As a result, the lateral shaft 44 and/or engagement elements 50 may move with a deflecting force without adversely affecting the desired set position of those elements.

Figure 3B:
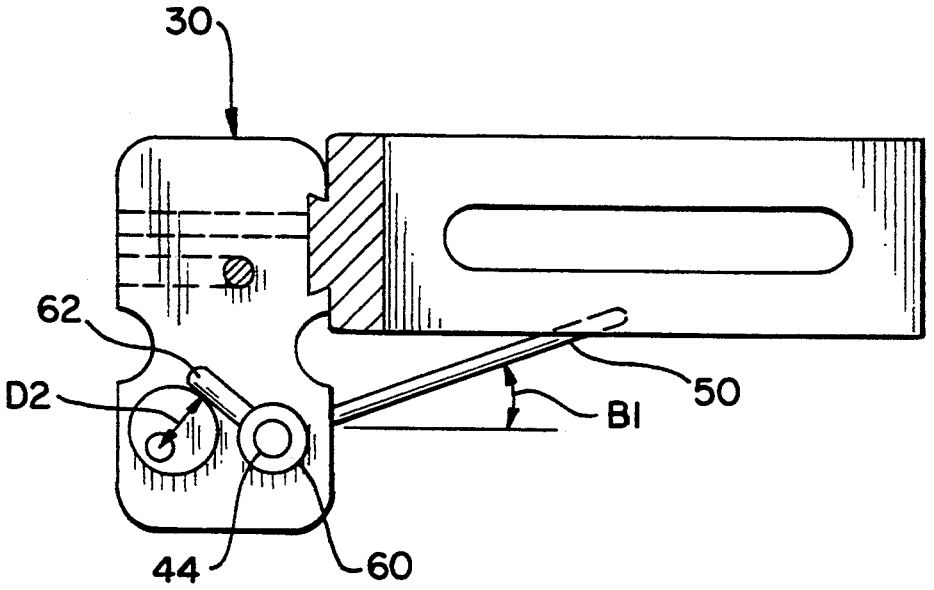

In FIG. 3*a*, the engagement finger 62 is held a distance D1 away from the pivot point of the cam member 64 by the body of the cam member. Referring to FIG. 3*b*, the position of the cam member 64 is now changed and the engagement finger 62 is held at a distance D2 away from the cam member pivot point, wherein the distance D2 is greater than the previous distance D1 of FIG. 3a. The increased distance D2, caused by the rotation of the cam member 64, moves the engagement finger 62 closer to the vertical. As a result, the lateral shaft 44 rotates and the arrow engagement elements 50 are held at an angle B' relative the horizontal, which is smaller than the angle B in FIG. 3a. Consequently, it can be seen that by altering the rotational position of the cam member 64, the angle of inclination for the arrow engagement elements 50 can be selectively adjusted as desired quickly and easily.

Figure 4:
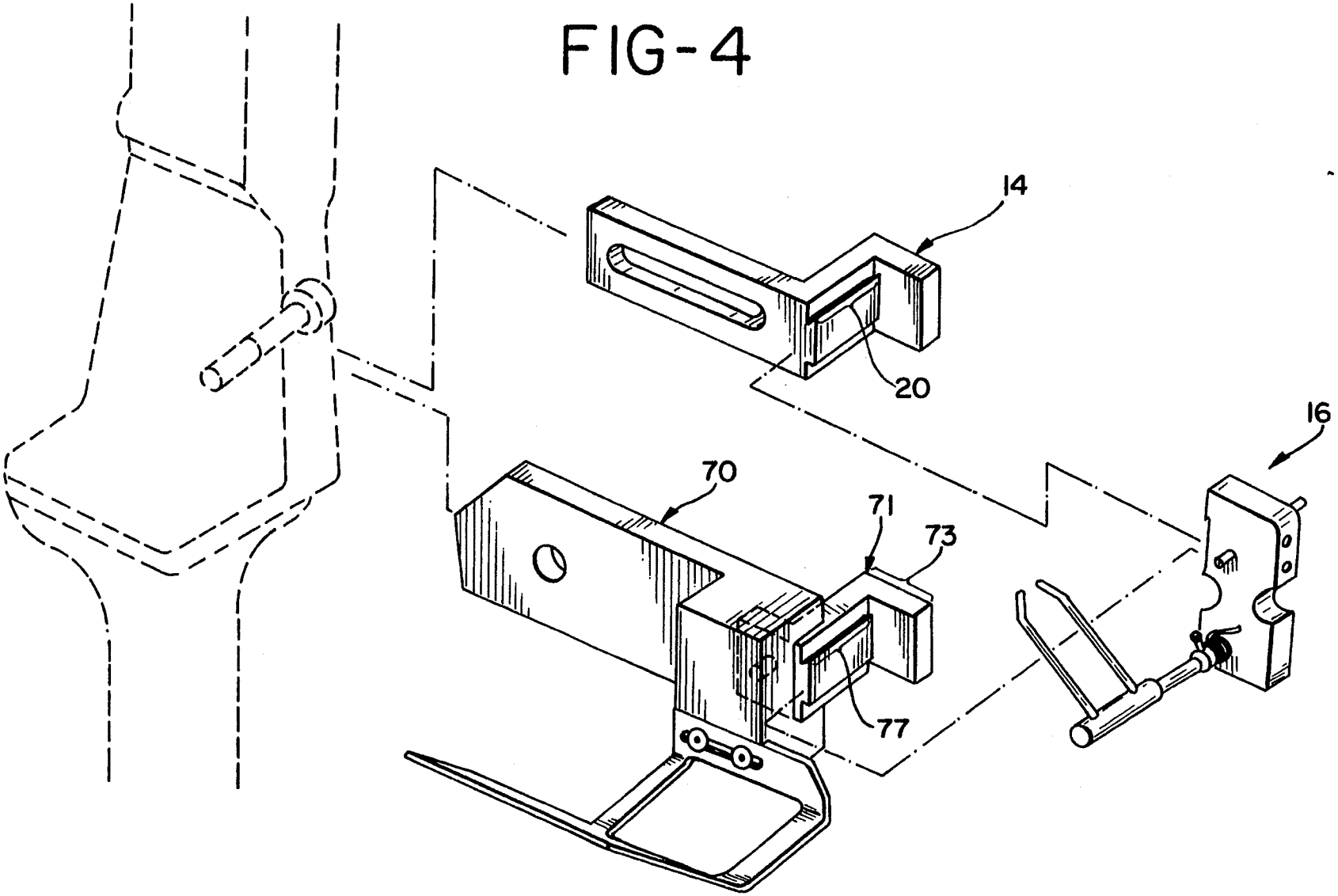
FIG. 4 is a perspective view of an alternate view of the present invention arrow rest apparatus showing the use of an overdraw assembly in a modular construction.

Referring to FIG. 4, there is shown an alternative modular embodiment of the present invention arrow rest. This arrangement includes the arrow support arrangement 16 and anchoring bracket 14 as have been previously described. However, the arrow support arrangement 16 need not attach to the anchoring bracket 14. Rather, an overdraw assembly 70 is provided. The overdraw assembly 70 includes a bracket 71 that has a dovetailed section 72 and an end stop section 73. The support block 30 within the arrow support arrangement 16 engages the dovetailed section 72 of the bracket 71 on the overdraw device 70 in the same manner that the support block 30 engages the dovetailed section 20 on the anchoring bracket 14. As a result, it will be understood that the arrow support arrangement 16 will attach to either the overdraw device 70 or the anchoring bracket 14 in the exact same manner.

Either the overdraw device 70 or the anchoring bracket 14 can be attached to the archery bow 11 by threaded fastener 26. As a result, to convert a bow from an overdraw bow to a standard bow, an archer need only remove the threaded fastener 26 and replace the overdraw device 70 with the anchoring bracket 14. The same arrow support arrangement 16 can be used on either the overdraw device 70 or the anchoring bracket 14. Consequently, an archer does not have to use a different arrow rest when changing back and forth between the use and non-use of an overdraw device.

It will be understood that the embodiments described herein are merely exemplary and that a person skilled in the art may make many variations and modifications to the described embodiments utilizing functionally equivalent components to those described. All such variations and modifications are intended to be included within the scope of this invention as defined by the appended claims.

What is claimed is:

1. An arrow rest apparatus, comprising:

a mounting element selectively mountable to an archery bow, wherein said mounting element includes an abutment surface;

an arrow support assembly having a rigid element extending therefrom, wherein said rigid element extends a predetermined distance from said arrow support assembly; and connecting means for selectively connecting said arrow support assembly to said mounting element, wherein said arrow support assembly can be linearly and reciprocally moved in relation to said mounting element from a first position where said rigid element abuts against said abutment surface to a second position where said arrow support assembly disengages from said mounting element;

adjustment means for selectively adjusting said predetermined distance that said rigid element extends from said arrow support assembly, thereby adjusting the relative position of said arrow rest assembly and said mounting element when said arrow rest assembly is at said first position, and enabling said arrow support assembly and said mounting element to be oriented in a positional relationship preferred by an archer, said adjustment means being independent of said connecting means wherein said arrow support assembly and said mounting element automatically assume said positional relationship as said arrow support assembly is connected to said mounting element and said rigid element abuts against said abutment surface.

2. The apparatus according to claim 1, further including locking means for selectively locking said arrow support assembly into said first position on said mounting element, thereby preventing said arrow support assembly from being inadvertently displaced from said first position.

3. The apparatus according to claim 2, wherein said locking means includes a threaded fastener that extends through said arrow support assembly and engages said mounting element, thereby preventing the reciprocal movement of said arrow support assembly relative said mounting element.

4. The apparatus according to claim 1, wherein said arrow support assembly includes a support block, a lateral shaft extending from said support block, and at least one arrow engagement element depending from said lateral shaft.

5. The apparatus according to claim 4, wherein said lateral shaft is rotatable relative said support block and the rotation of said lateral shaft changes the orientation of said at least one arrow engagement element relative said support block.

6. The apparatus according to claim 5, further including stopping means for stopping said lateral shaft from rotating in one direction beyond a fixed position, and further including spring means for biasing said lateral shaft into said fixed position.

7. The apparatus according to claim 6, further including means for selectively altering said fixed position, thereby adjusting the position into which said lateral shaft is biased and altering the orientation of said at least one arrow engagement element relative said support block.

8. The apparatus according to claim 7, wherein said adjustment means includes an engagement element radially extending from said lateral shaft that is biased against a cam surface by said spring means, said cam surface being positionally adjustable relative said engagement element, thereby altering the point said engagement element engages said cam surface and altering said fixed position of said lateral shaft.

9. The apparatus according to claim 1, further including an overdraw assembly adapted to receive said mounting element, whereby said overdraw assembly joins said mounting element to said archery bow.

10. An arrow rest assembly comprising:

a mounting member selectively mountable to an archery bow;

a support member for supporting at least one arrow engagement element, wherein said support member is rotatably coupled to said mounting member, said support member having at least one engagement element extending therefrom that travels across a first arcuate path as said support member rotates relative said mounting member, whereby the orientation of said at least one arrow engagement element relative said archery bow is dependent upon the rotational orientation of said support member relative said mounting member;

a contact member coupled to said mounting member at a point of rotation, said contact member being selectively rotatable around said point of rotation, wherein said contact member follows a second arcuate path that intersects said first arcuate path across a predetermined range, thereby providing for a point of contact between said contact member and said engagement element in said predetermined range;

adjustment means for adjusting the position of said contact member in said predetermined range thereby selectively varying said point of contact in said predetermined range; and spring bias means for biasing said engagement element against said contact member, whereby the position of said point of contact determines the rotational position of said support member relative said mounting member and thus the position of said at least one arrow engagement element relative said archery bow.

11. The assembly according to claim 10, wherein said contact element is a cam having a generally round profile, said cam being eccentrically disposed around said point of rotation.

12. The assembly according to claim 10, wherein said adjustment means includes a threaded fastener that passes through said contact member at said point of rotation joining said contact member to said mounting member, said threaded fastener selectively locking said contact member into one position in said predetermined range thereby setting a fixed point of contact.

13. The assembly according to claim 10, wherein said support member includes an elongated shaft wherein said engagement element radially extends from said elongated shaft.

14. The assembly according to claim 10, wherein said contact member is a cam having a cam surface that varies in its distance from said point of rotation.

15. A modular arrow rest apparatus, comprising:

an overdraw assembly selectively mountable to an archery bow when desired;

a mounting plate selectively mountable to said archery bow when desired, wherein said overdraw assembly and said mounting plate share a commonly shaped attachment surface;

at least one interchangeable arrow support assembly preadjusted for a specific shooting condition and selectively attachable to said attachment surface, whereby the same arrow support assembly can be used independently with said overdraw assembly and said mounting plate depending upon the needs of the archer.

16. The apparatus according to claim 15 further including a locking means for locking said arrow support assembly onto said attachment surface, thereby preventing any inadvertent movement of said arrow support assembly in relation to said attachment surface.

17. The apparatus according to claim 15 wherein said arrow support assembly includes at least one adjustment mechanism for adjusting said arrow support assembly to a desired shooting condition.

18. The arrow rest apparatus according to claim 15, wherein said arrow support assembly includes connecting means for selectively connecting said arrow support assembly to said attachment surface, and adjustment means for selectively adjusting the relative position between said arrow support assembly and said attachment surface, wherein said arrow support assembly can be oriented at a predetermined position preferred by the archer when said arrow support assembly is attached to said attachment surface, said adjustment means being independent of said connecting means wherein, when said adjustment means is set for said predetermined position, said arrow support assembly automatically assumes said predetermined position as said arrow support assembly is connected to said attachment surface without further need of adjustment.

19. An arrow rest assembly, comprising:

a mounting member mountable to an archery bow;

an elongated member for supporting at least one arrow engagement element, said elongated member being joined to said mounting member in a manner that enables said elongated member to rotate about its longitudinal axis through an arcuate range, whereby the position of said at least one arrow engagement element relative the archery bow is dependent upon the rotational position of said elongated member relative the mounting member;

a stopping means disposed between said elongated member and said mounting member at a predetermined position within said arcuate range, said stopping means preventing the rotation of said elongated member beyond said predetermined position in said arcuate range, thereby preventing said at least one arrow engagement element from rotating beyond a corresponding orientation with respect to the archery bow;

biasing means for biasing said elongated member against said stopping means, thereby biasing said elongated member in said predetermined position;

adjustment means coupled to said stopping means for selectively changing said predetermined position in said arcuate range, thereby selectively adjusting the orientation at which said at least one arrow engagement element is biased.

* * * * *